US005240338A

United States Patent [19]

Jye

[11] Patent Number: 5,240,338

[45] Date of Patent: Aug. 31, 1993

[54] MULTIFUNCTIONAL DRAWING AND WRITING INSTRUMENT

[76] Inventor: Ji P. Jye, Suite 1, 11F, 95-8 Chang Ping Road, Sec. 1, Taichung, Taiwan

[21] Appl. No.: 837,060

[22] Filed: Feb. 18, 1992

[51] Int. Cl.[5] ..... B43K 29/08; B43L 9/04; B26B 11/00

[52] U.S. Cl. ..... 401/195; 401/52; 33/27.03; 7/163

[58] Field of Search ..... 401/52, 195; 33/27.02, 33/27.03, 26; 7/158, 150, 163

[56] References Cited

U.S. PATENT DOCUMENTS

| | | | |
|---|---|---|---|
| 717,871 | 1/1903 | Lehischuh | 33/27.02 |
| 752,699 | 2/1904 | Neukirchen | 33/27.02 |
| 996,359 | 6/1911 | Piggott | 33/27.02 |
| 1,458,046 | 6/1923 | Garlatti | 33/27.03 |
| 1,488,875 | 4/1924 | Franklin et al. | 33/27.02 |
| 2,505,437 | 4/1950 | Skolnick | 33/27.02 |
| 4,815,881 | 3/1989 | Chern | 401/195 X |

FOREIGN PATENT DOCUMENTS

| | | | |
|---|---|---|---|
| 3735416 | 5/1989 | Fed. Rep. of Germany | 401/195 |

*Primary Examiner*—Danton D. DeMiller

[57] ABSTRACT

The present invention is to provide a multifunctional drawing and writing instrument of a type wherein all of its pieces work together to perform a variety of functions that would otherwise require the use of several separate devices. The instrument shall be functional as a pen, a ruler, and a compass; all in one compact and convenient form. From its simple structure as a pen, it can be taken apart and reassembled as a compass, and parts thereof can further be utilized as a ruler.

7 Claims, 4 Drawing Sheets

MULTIFUNCTIONAL DRAWING AND WRITING INSTRUMENT

BACKGROUND OF THE INVENTION

The present invention relates to a multifunctional drawing and writing instrument, and more particularly to a combination of: reversible pen (two colors); an extendible ruler; and a compass.

Conventional writing and drawing instruments are generally separate. As you know, when one wants to do a drawing or write, they need to have the proper instruments. A drawing that would include circles and lines will generally require no less than three instruments. If a second color is desired, a fourth instrument would be needed.

Invariably a search would probably be made to find the necessary instruments required to perform the job. A search as such, could not only waste time, but also be frustrating. If a blue pen is desired, a blue pen is sought. If a black pen is then desired, a black pen is sought. Now a straight line is called for, so there is a search for a ruler. As the project continues, it comes time to draw arc and circles, so a compass must be found. Now that all the instruments are at hand, there is a pile on the table, taking up space and getting in the way. The cost of such a group of instruments may also be a consideration. For these reasons it is desirable to integrate several drawing implements, for ease of use and accessibility. With such an instrument, one can perform many functions with one instrument, whereas they would otherwise necessitate the use of many. They would not have to search for many instruments, only the one. They would not have the clutter of many instruments, only the convenience of the one at hand.

SUMMARY OF THE INVENTION

The main object of the present invention is to provide a multifunctional drawing and writing instrument which is comprised of pens of two different colors, a ruler, and a compass. With such an instrument, it would not be necessary to search for many separate instruments to perform simple writing and drawing tasks. It would be more convenient, less time consuming, and take up less space. Furthermore, it would be less costly to purchase a single instrument which performs many functions, than to purchase several instruments to perform same functions.

This is accomplished by integrating several drawing implements into one compact form. The structure of the invention is such that in its simple and compact for it resembles a pen. This can be taken apart and be reassembled as a compass, and parts thereof can be further utilized as a ruler. The structure is also such that with the simple pull of a pin, the colors can easily be changed. There are three common drawing implements that have thus been integrated into said multifunctional instrument.

The first implement being a reversible pen, whereby the user can periodically change colors (two) at will. The pens will also cooperate in use as the drawing end of the compass.

The second implement is a compass. But not of the conventional V shaped type. The provided compass will be comprised of: A centering pin, secured in place by a device actuating 5 needled pins; A measured groove shaft; A pen; and an angled slot (on the bullet shaped end of the instrument embodiment) wich will connect with the ruler, wich forms the shaft. The inclined slot will enable the pen embodiment to be angled, whereby the user can draw concentric circles without direct impediment of thier hands, and or arms.

The third implement, a ruler, whereby it is extendible, and can be inserted within the embodiment of the instrument, and perform several functions. First, the primary function of a ruler, as a straight rigid strip used for measuring lengths and drawing straight lines. Second, as a measuring implement for use in determining the desired circumference of circles and or circular arcs when in use with the compass. Third, as the shaft of the compass.

Further objects and advantages of the present invention will become readily apparent with reference to the detailed description of the preferred embodiment thereof provided below along with accompanying drawings.

A BRIEF DESCRIPTION OF THE DRAWINGS

The invention is now described in further detail with reference to a preferred embodiment thereof, illustrated by the accompanying drawings, in which.

DETAILED DESCRIPTION OF THE PREFERRED EMBODIMENT

Figure 1:
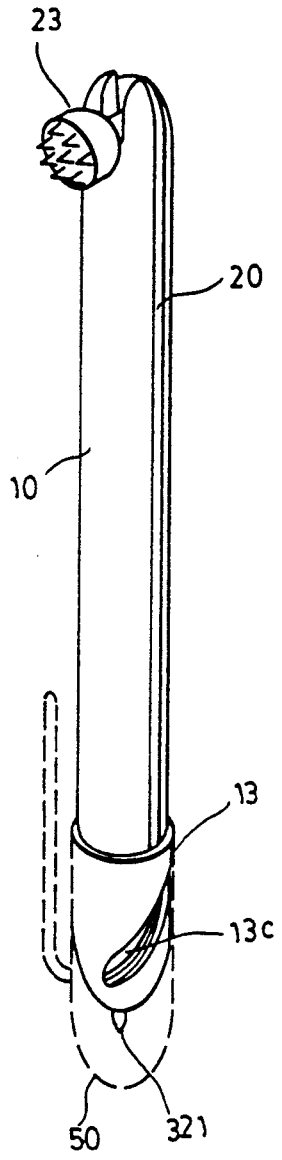
FIG. 1 is a frontal view of the full embodiment, with a sectional view of the protective cap.
Figure 2:
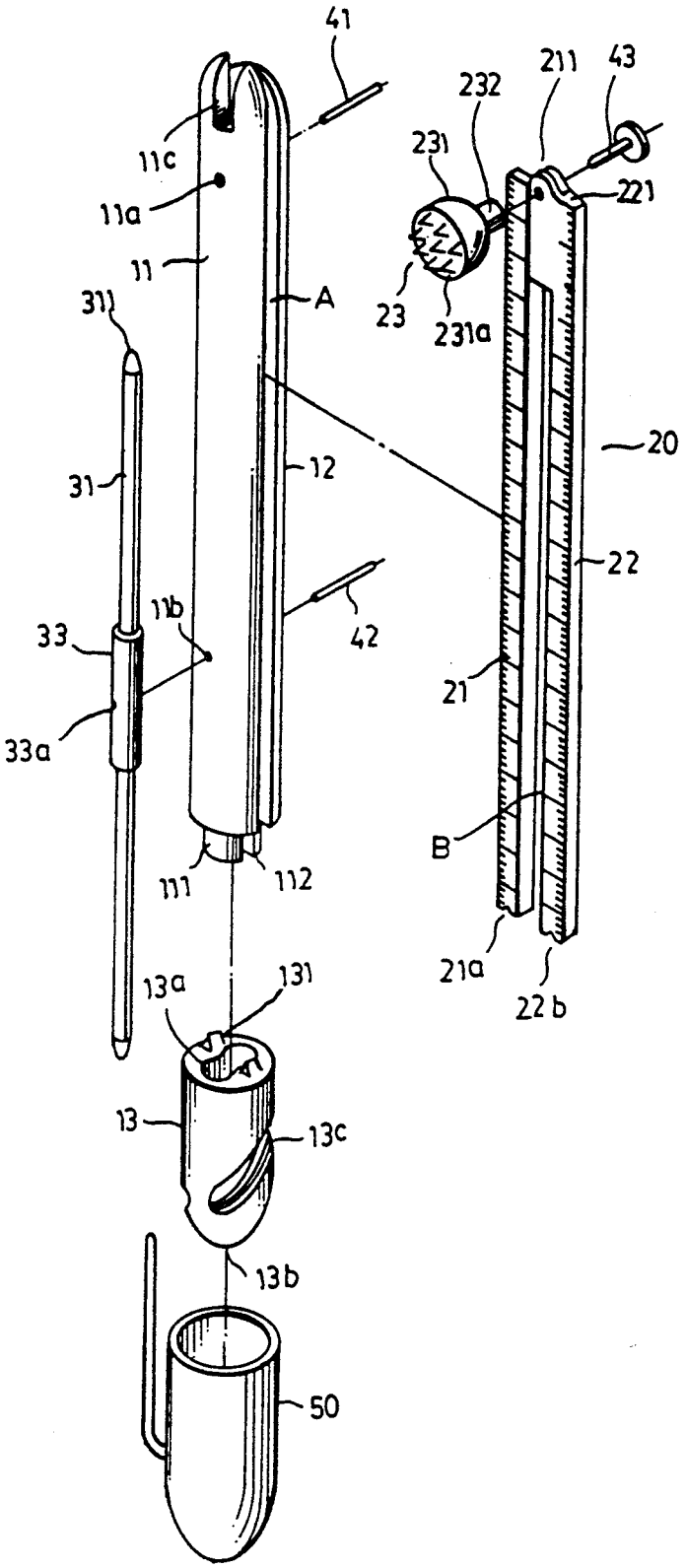
FIG. 2 is a dissected lateral view of the full embodiment wherein all of the accompanying structures are shown separately.
Figure 4:
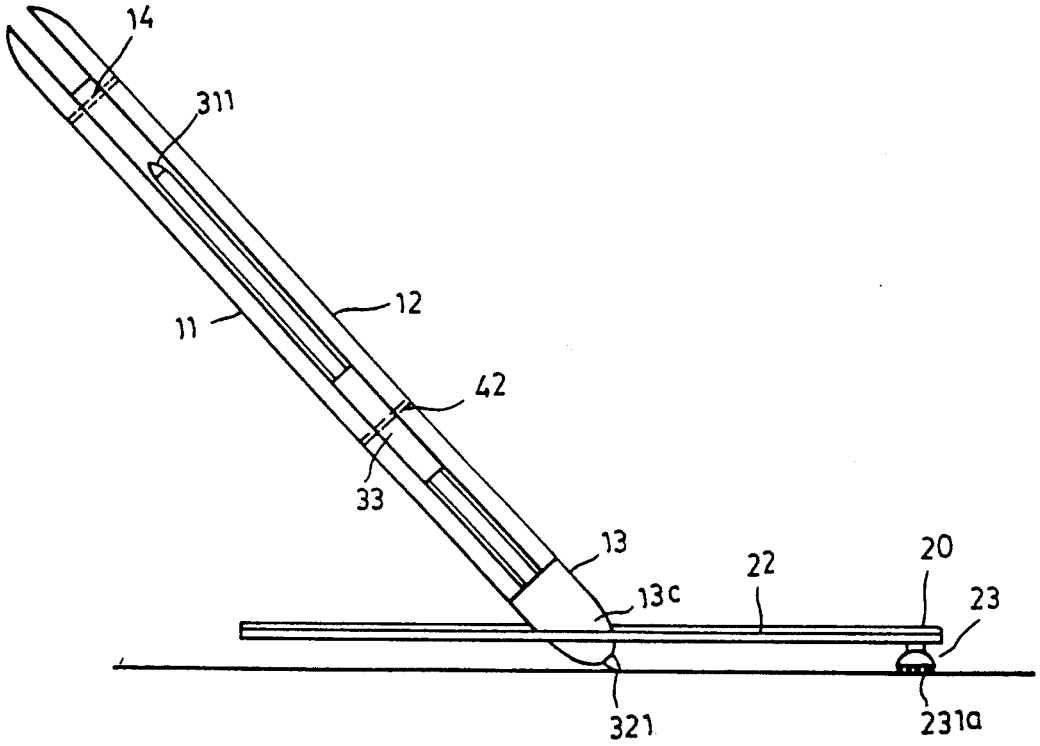
FIG. 4 is a side view of the full embodiment in use as a compass.

Referring to FIGS. 1, 2 and 4, a multifunctional drawing and writing instrument is provided which comprises a cylindrical casing 1 which is composed of a left half 1*a*, with protruding insert 12 at its base, penetrating hole 34 in its lower portion, penetrating hole 35 in its upper portion and a recessed top 30; a right half 1*b*, which has protruding insert 12 at its base, penetrating hole 34 in its lower portion, penetrating hole 35 in its upper portion, and an arced top with penetrating hole 31; spacer 33; and cavity 13; blue pen 41, black pen 42, and connecting collar 4 with penetrating hole 34; ruler 5 with ruler scale 52, compass scale 51, joint flange 58, penetrating hole 36, and recessive seats 59; protective cap 3 with pocket clip 37; bullet shaped attachment 2 with inclined slot 22, penetrating hole 38, receiving cavity 21, and prismatic protrusions 60; centering pin 56 with pin 56*a* and knob 56*b*; securing device 55 with bolt type end 55*b*, flared end 55*a*, needled pin attachments 54, and penetrating hole 39; and holding pins 11*a* and 11*b*.

The structure of the invention is such that all parts thereof work together in relation to one or another to perform a desired function. Cylindrical casing 1, which together with bullet shaped attachment 2 form the main body of the instrument, is host to pens 41,42 as well as ruler 5. Cylindrical casing 1, secures itself to bullet shaped attachment by way of protruding inserts 12, which fit into receiving cavity 21. The two halves of the cylindrical casing 1 are attached together at the base by protruding inserts 12, and at the top by spacer 33. The connecting collar 4, which connects pens 41,42 end to end, is secured within cavity 13 of the cylindrical casing 1 by holding pin 11*b*, which is inserted through penetrating hole 34, and is removable so as to enable said pens to be changed to the desired color. Holding pin 11*a* is inserted through penetrating hole 35 of cylindrical casing 1 and spacer 33 to further secure halves 1*a* and 1*b*; Holding pin 11*a* is permanant in position. At the top of cylindrical casing 1, half 1*a*, is recessed notch 30, which provides a seat for securing device 55 of which bolt type end 55*b* sits within the recessed notch 30. The top of cylindrical casing 1, half 1*b*, is arced, containing penetrating hole 31, which is used by centering pin 56 to hold securing device 55 within the recessed notch 30.

Referring to FIG. 2 and 4. Bullet shaped attachment 2, is fitted to the cylindrical casing by way of protruding inserts 12 which fit within receiving cavity 21. Within bullet shaped attachment 2 is penetrating hole 38 which goes through the tip of said attachment, and is the exit point for pen tips 41,42. About halfway down the exterior of bullet shaped attachment 2 begins a partial diagonal cut that makes up inclined slot 22; this slot serves as a guide in connection with ruler 5 in their function as a compass (as seen in FIG. 4.) To serve its function, ruler 5 folds in half with its edges fitted within the recess of inclined slot 22, enabling the main body of the instrument to move along the shaft created by ruler 5, which contains compass scale 51. On the top of bullet shaped attachment 22 are prismatic protrusions 60, set to fit within cavity 13 of cylindrical casing 1. These protrusions are used by recessive seats 59 to provide for a secure fitting of ruler 5 within cavity 13 of cylindrical casing 1.

Figure 3:
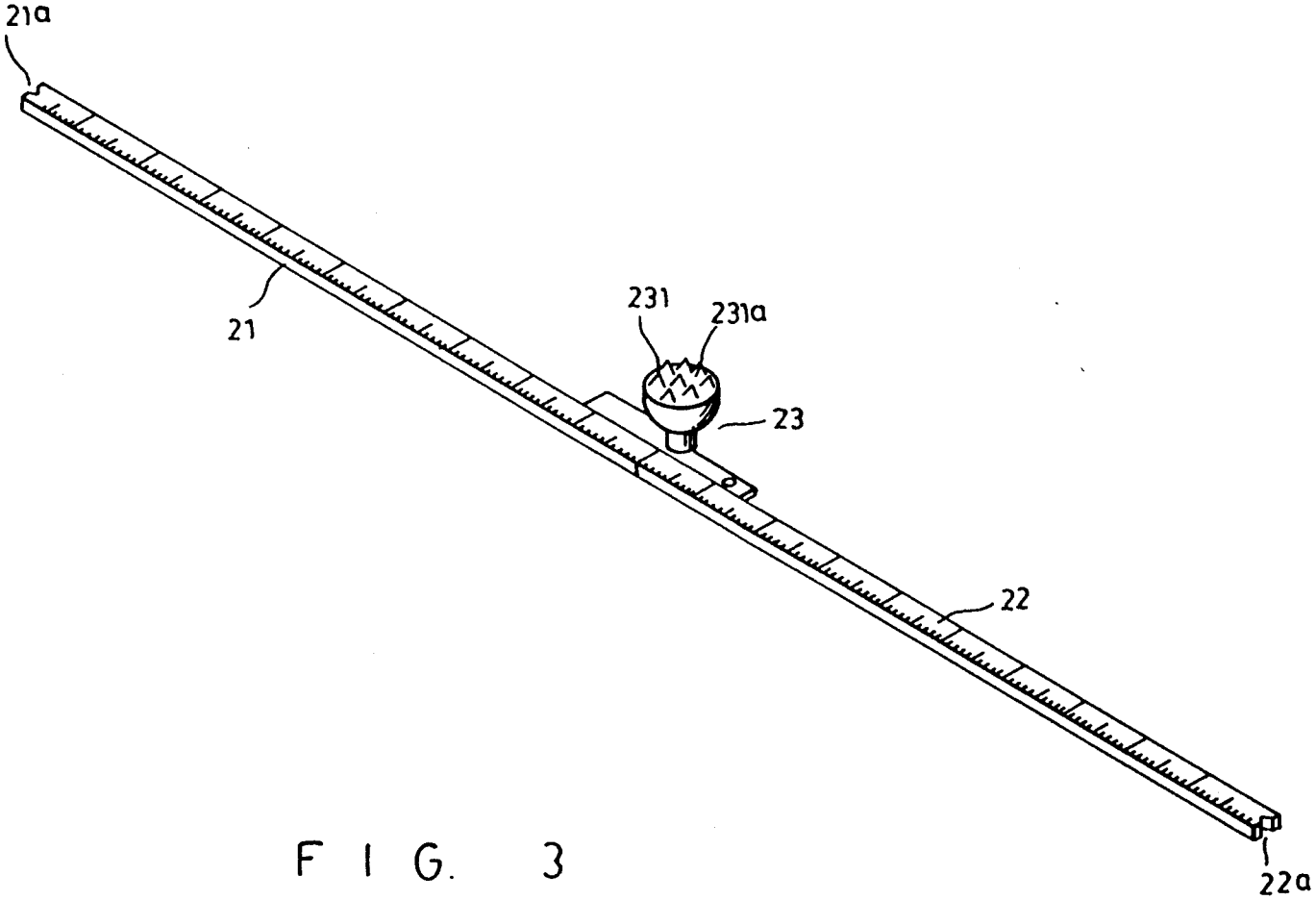
FIG. 3 is a lateral view of the ruler, showing it in full extension, it is also the bottom view of the compass scale. Also shown is the base of the centering pin and needled pin embodiment.

Referring to FIGS. 2,3 and 4. Ruler 5 serves multiple functions; ruler with ruler scale 52, in connection with the compass with compass scale 51, shaft of the compass in connection with inclined slot 22, and as the base of the compass in connection with securing device 55 and centering pin 56. The two ends of the ruler arms contain recessive seats 59 which, when ruler is folded and fitted within cavity 13 of cylindrical casing 1, provides a secure fitting and prevents any unnecessary movement within cavity 13. The ruler arms are connected at joint flange 58 which serves as the base of the compass. In joint flange 58, is penetrating hole 36 through which pin 56*a* of centering pin 56 fits to make its insertion into penetrating hole 39 of securing device 55. Joint flange 58 serves as the extension point of ruler 5. Penetrating hole 39 serves as the point whereby ruler 5 is fastened within the main body of the instrument: By insertion of pin 56*a* of centering pin 56; through penetrating hole 35 of the right half 1*b* of cylindrical casing 1, through penetrating hole 36 of joint flange 58 of ruler 5, and into penetrating hole 39 of securing device 55. Penetrating hole 39 also serves as the point whereby securing device 55 is connected to ruler 5 to form the base of the compass. Ruler 5 forms the shaft of the compass when it is fitted within the recess of inclined slot 22; enabling the main body of the instrument to move along the length of its arm which is marked with compass scale 51, thereby enabling the user to draw measured circles and or arcs.

Securing device 55 is connected to ruler 5 by way of centering pin 56, and forms the base of the compass. Attached to the base of flared end 55*a*, are five needled pin attachments 54, which are used to secure the compass to a desired drawing surface. Bolt type end 55*b* of securing device 55 sits within recessed notch 30 of cylindrical casing 1 when the instrument is not in use as a compass. It is connected therein by centering pin 56. Penetrating hole 39 serves as the insertion point of centering pin 56 wherein pin 56*a* is used as the center point of the compass, and connects securing device 55 with joint flange 58 of ruler 5. Penetrating hole 39 further functions as the point whereby centering pin 56 holds ruler 5 within cavity 13 of cylindrical caseing 1 by attachment to securing device 55.

Protective cap 3 is used to protect inclined slot 22 of bullet shaped attachment 2, as well as blue pen 41 and black pen 42 (whichever is extended through penetrating hole 38) when the instrument is not in use.

I claim:

1. A multifunctional drawing instrument comprising:

a) a straightedge member comprising:

i) a first and second elongate members hingedly attached at respective first ends thereof, each elongate member having a generally planar surface for resting said straightedge member on a drawing surface, and a cooperating stop surface for limiting further rotation of a first elongate member away from a second elongate member when the first and second elongate members are in parallel registry;

ii) positioning means disposed over the hinge axis defined between the first and second elongate members on a side opposite from the planar surfaces thereof, for maintaining said straightedge member over a selected position on a drawing surface with the first and second elongate members being separated from the drawing surface by a predetermined space;

b) an elongate body having;

i) an axially aligned receiving space defined therein for housing said straightedge member when the first and second elongate members thereof are folded together;

ii) an aperture on the terminal end of a first end portion of said body;

iii) an arcuate slot formed on a periphery of the first end portion of said body at a predetermined acute angle with respect to a longitudinal axis thereof and penetrating into said body to a predetermined depth, for engaging a longitudinal edge portion of an elongate member when spaced from a drawing surface by said positioning means so that the aperture of said body is proximate the drawing surface;

c) at least one delineating member releasably secured within said body and having a marking tip on a first end thereof extendible through the aperture of said body;

d) securing means for releasably securing said straightedge member to said body within the receiving space thereof.

2. A multifunctional drawing instrument according to claim 1, wherein said positioning means comprises a generally disc shaped base having a plurality of pointed projections depending from a lower surface thereof for engagement with a drawing surface.

3. A multifunctional drawing instrument according to claim 2, wherein the slot on said body is inclined at an approximately 45 degree angle with respect to a longitudinal axis thereof.

4. A multifunctional drawing instrument according to claim 3, wherein each elongate member of said straightedge member has ruling indicia provided along the longitudinal edge portion thereof.

5. A multifunctional drawing instrument according to claim 4, wherein:

the first end portion of said body comprises a separate member releasably secured to a major portion thereof;

the major portion comprises two longitudinally divided half members separated to define the receiving space for said straightedge member and adjoined at a medial position proximate a second end of said body by an inner cross member.

6. A multifunctional drawing instrument according to claim 5, wherein said at least one delineating member comprises a first and second delineating members and a coupler element connecting respective ends of the first and second delineating member opposite the marking tips thereon, the coupler element being releasably secured to a central portion of said body by a pin engaged with registered holes in the first and second half members and coupler element.

7. A multifunctional drawing instrument according to claim 6, wherein said securing means comprises:

an axially aligned groove on an end of a first half member opposite from the first end portion of said body, and a pair of first mating surfaces on an end of the first end portion adjacent the major portion of said body, the first mating surfaces being in communication with the receiving space;

a space defined between the first and second elongate members when folded together, a reduced diameter neck adjoining the base of the positioning means with said straightedge member for engagement with the groove on said body, and respective second mating surfaces on the terminal ends of the first and second elongate members for engagement with the first mating surfaces on the first end portion of said body.

* * * * *